United States Patent [19]

Kovacs

[11] 4,155,080

[45] May 15, 1979

[54] PROTECTIVE ARRANGEMENT FOR ANALOG SENSOR MULTIPLEXING SYSTEM

[75] Inventor: Laszlo Kovacs, Churchville, Pa.

[73] Assignee: Fischer & Porter Company, Warminster, Pa.

[21] Appl. No.: 870,063

[22] Filed: Jan. 17, 1978

[51] Int. Cl.[2] ..... G08B 21/00

[52] U.S. Cl. ..... 340/595; 324/51; 340/652

[58] Field of Search ..... 340/147 C, 595, 635, 340/652, 661; 324/51, 73 R, 111; 307/117

[56] References Cited

U.S. PATENT DOCUMENTS

| | | | |
|---|---|---|---|
| 2,040,495 | 5/1936 | Nichols | 324/51 X |
| 2,576,892 | 11/1951 | Stanton | 324/73 R |
| 2,937,369 | 5/1960 | Newbold et al. | 324/111 X |
| 3,582,926 | 6/1971 | Hassan | 340/595 X |
| 3,590,370 | 6/1971 | Fleischer | 340/652 X |
| 3,617,886 | 11/1971 | Werme | 324/51 X |
| 3,755,688 | 8/1973 | Hohler | 340/652 X |
| 3,760,265 | 9/1973 | Hutch | 340/652 X |
| 3,829,849 | 8/1974 | Stauffer | 340/595 X |
| 3,883,753 | 5/1975 | Harrison, Jr. et al. | 340/661 X |
| 3,973,184 | 8/1976 | Raber | 324/51 |

*Primary Examiner*—John W. Caldwell, Sr.
*Assistant Examiner*—Daniel Myer
*Attorney, Agent, or Firm*—Michael Ebert

[57] ABSTRACT

A protective arrangement operating in conjunction with a multiplexing system adapted to convey data from a plurality of low-impedance analog sensors to a central digital receiving terminal. Each sensor is coupled by an input line through a noise-rejection filter that includes a capacitor connected across the line to a commutator serving to sequentially sample analog data derived from the sensors and to apply the samples to an analog-to-digital converter. The protective arrangement functions to detect the occurrence of an open circuit in any one of the sensors and to produce an indication of this abnormal condition, the arrangement including a like plurality of photon-couplers, one for each sensor. The light-emitting diode of each photon-coupler is energized by a power source common to all sensor circuits. The light emitted by the diode is intercepted by a photo-transistor connected through resistors of high value across the related sensor input line to define a network generating a small offset-current. Under normal conditions, the low-impedance sensor shunted across the high-impedance network renders the offset current ineffective; but should an open-circuit occur, the offset current then serves to charge the capacitor of the filter to a high level with a polarity opposed to the normal polarity established thereacross by the sensor. As a consequence, the digital value produced by the converter in response to the sample taken from the open-circuited sensor has an abnormal level well outside the valid range, thereby providing an indication of the abnormal condition.

9 Claims, 6 Drawing Figures

Figures 1, 2:
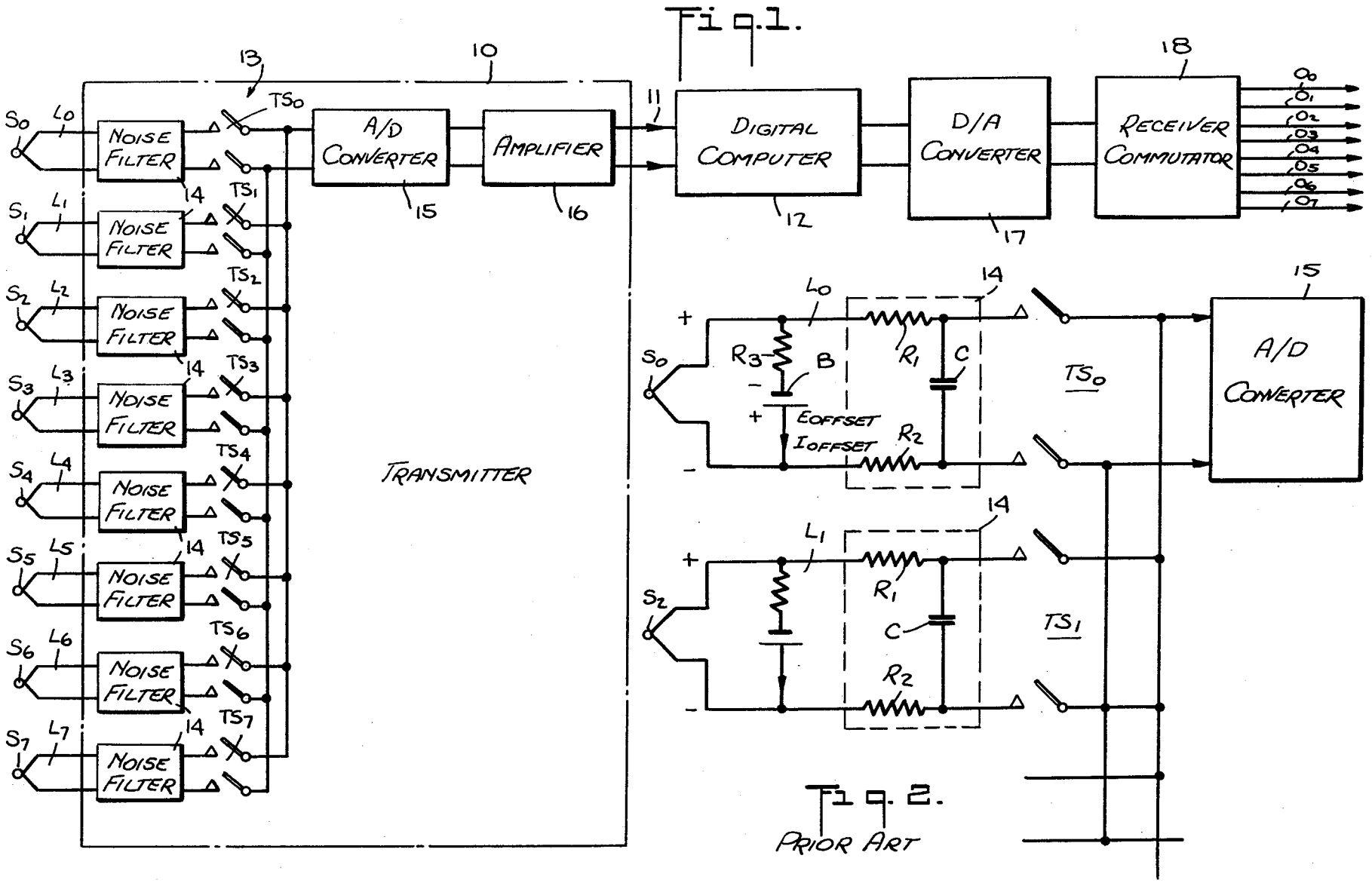
Fig. 2. Prior Art

Receiver Commutator
D/A Converter
Digital Computer
A/D Converter
Amplifier
Transmitter
Noise Filter
A/D Converter

PROTECTIVE ARRANGEMENT FOR ANALOG SENSOR MULTIPLEXING SYSTEM

BACKGROUND OF INVENTION

This invention relates generally to a multiplexing system adapted to sequentially convey data samples derived from a plurality of analog sensors to a receiving terminal, and more particularly to a protective arrangement for detecting the occurrence of an abnormal condition in any one of the sensor circuits and to indicate this condition.

In industrial process control, it is necessary to transmit data obtained at various points in the field to a central computer or control station. The data to be conveyed to the common receiving terminal may be changes in pressure, temperature, flow rate or any other process variable. Generally, this data is derived by means of individual analog sensors which convert the process variable at the various points into corresponding analog signals.

A telemetering system in which the output of each analog sensor is fed to the remote terminal over a separate wire line is usually not feasible, particularly when many sensors are involved. The large number of lines then entailed and their lengths make a multi-line system prohibitively expensive.

Multiplexing techniques are known which act to sequentially transmit digital values derived from data generated by analog sensors to a digital computer or other receiving terminal over a single main channel, thereby obviating the need for as many telemetering lines as there are sensors. A time-division multiplexing system of this type employs an electronic or mechanical commutator at the transmission station to sequentially sample the data produced by each analog sensor, the output of the commutator being applied to an analog-to-digital (A/D) converter.

To effect process control, the output of the A/D converter is applied to a central digital computer which functions by means of a receiver commutator running in synchronism with the transmitter commutator to sequentially control the sensed processes through final control elements. If, for example, each analog sensor in the analog sub-system is a thermocouple which senses the prevailing temperature in a process line, the final control element related to this sensor may be a valve adapted to supply a cooling medium to the line to an extent necessary to adjust the temperature therein to conform the process temperature to a set point with which the process variable is compared.

But if an abnormal condition develops in a given sensor, such as an open circuit, the operation of the associated final control element is then out of control, and in an unmonitored process this may have serious consequences. It is desirable, therefore, to provide a protective arrangement in conjunction with each analog sensor included in the multiplexing system to detect the occurrence of an abnormal condition and to sound an alarm or afford some other indication so that an operator can be alerted to take steps to prevent damage to the unmonitored equipment or process.

One known type of protective arrangement for this purpose takes the form of a centrally-powered detector which applies an offset current to the common line extending between the commutator coupled to the plurality of analog sensors and the A/D converter that sequentially converts the sampled analog values derived from these sensors into the corresponding digital signals.

With this known protective arrangement, if the particular analog sensor being sampled by the commutator is in its normal low-impedance closed state, the A/D converter will then convert the analog value produced thereby into a digital value lying within a valid range. But if the sampled analog sensor circuit is open and therefore defective, then the offset current will generate an exceptionally large offset voltage across the open impedance, and the A/D converter will then convert this voltage to a digital value well beyond the valid range. The indication resulting from this abnormal value provides the required alarm.

A centrally-powered protective arrangement which produces an offset current common to all of the sequentially-sampled analog sensor circuits introduces an error value which is added to each analog input and creates a problem that dictates some means to effect error correction. But a more serious drawback of this known arrangement is that it precludes the use of a noise rejection R-C filter in conjunction with each analog sensor circuit.

A filter of this type serves to discriminate between the useful analog signal and background noise transients, thereby enhancing the signal-to-noise ratio of the analog input sub-system. However, with a centrally-powered protective arrangement, input filtering cannot be used, for the filter capacitor looks like a short circuit to the offset current pulse. This limits the normal-mode noise rejection ability of the entire analog input sub-system.

To overcome the deficiencies of a centrally-powered protective arrangement and make it possible to include a noise rejection filter for each sensor, it is known to provide an individually-powered arrangement wherein offset current is applied to each analog sensor input line from an individual power source in series with a resistor of high value. Inasmuch as a protective arrangement in accordance with the invention also applies an offset current to each sensor input line, the distinctions between the previously known protective arrangement of this type and the present arrangement and the advantages to be gained by the latter will explained in the subsequent section of this specification which describes the invention in detail.

SUMMARY OF INVENTION

In view of the foregoing, the main object of this invention is to provide a protective arrangement to detect the occurrence of an abnormal condition in any one of a plurality of sensor circuits in the input sub-system of a multiplexing system and to indicate this condition.

More particularly, an object of this invention is to provide a protective arrangement for a plurality of thermocouple sensors each coupled by an input line to a commutator through a noise-rejection filter, the arrangement being constituted by a like plurality of opto-isolators or photon-couplers whose light-emitting diodes are energized by a common source which is electrically isolated from the sensor circuits.

A significant advantage of a protective arrangement in accordance with the invention is that it obviates the need for individual power sources to produce an offset current. Moreover, the offset current does not give rise to an error signal as with known types of centrally-powered protective arrangements.

Yet another object of this invention is to provide a protective arrangement in which a low-cost photon-coupler is associated with each analog sensor line and in which a common battery or power supply supplies excitation current to the light-emitting diodes of the several photon-couplers at a current level well below their normal specification whereby the effective life of the battery is prolonged.

Also an object of the invention is to provide a maintenance-free protective arrangement in which the plurality of photon-couplers associated with the plurality of sensors have their diodes powered from a common source and in which the supply of power to the diodes is programmed to operate during a check-cycle only, thereby minimizing the power consumed by the protective arrangement.

Briefly stated, these objects are attained in a protective arrangement operating in conjunction with a multiplexing system adapted to convey data from a plurality of low-impedance analog sensors to a central digital receiving terminal. Each sensor is coupled by an input line through a noise rejection filter that includes a capacitor connected across the line to a commutator serving to sequentially sample the analog data from the sensors and to apply the samples to an analog-to-digital converter.

The protective arrangement functions to detect the occurrence of an open circuit in any one of the sensors and to produce an indication of this abnormal condition. The arrangement includes a like plurality of photon-couplers, one for each sensor. The light-emitting diode of each photon-coupler is energized by a power source common to all photon-couplers, the light emitted by the diode of each photon-coupler being intercepted by a photo-transistor which is connected through resistors of high ohmic value across the line to define a network generating a small offset current.

Under normal operating conditions, the low impedance sensor shunted across the high impedance network renders the offset current ineffective; but should an open-circuit occur, the offset current then serves to charge the capacitor of the filter to a high level with a polarity opposed to the normal polarity thereacross established thereacross by an operative sensor. As a consequence, the digital value produced by the converter in response to the sample taken from the open-circuited sensor has an abnormal level well outside the valid range, thereby providing an indication of the open-circuit condition.

OUTLINE OF DRAWINGS

Figure 4A:
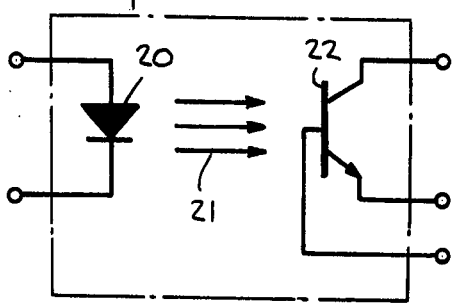
Figure 4B:
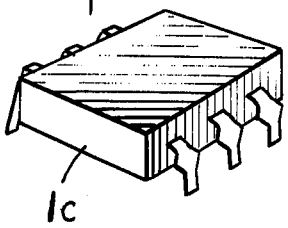
Figure 3:
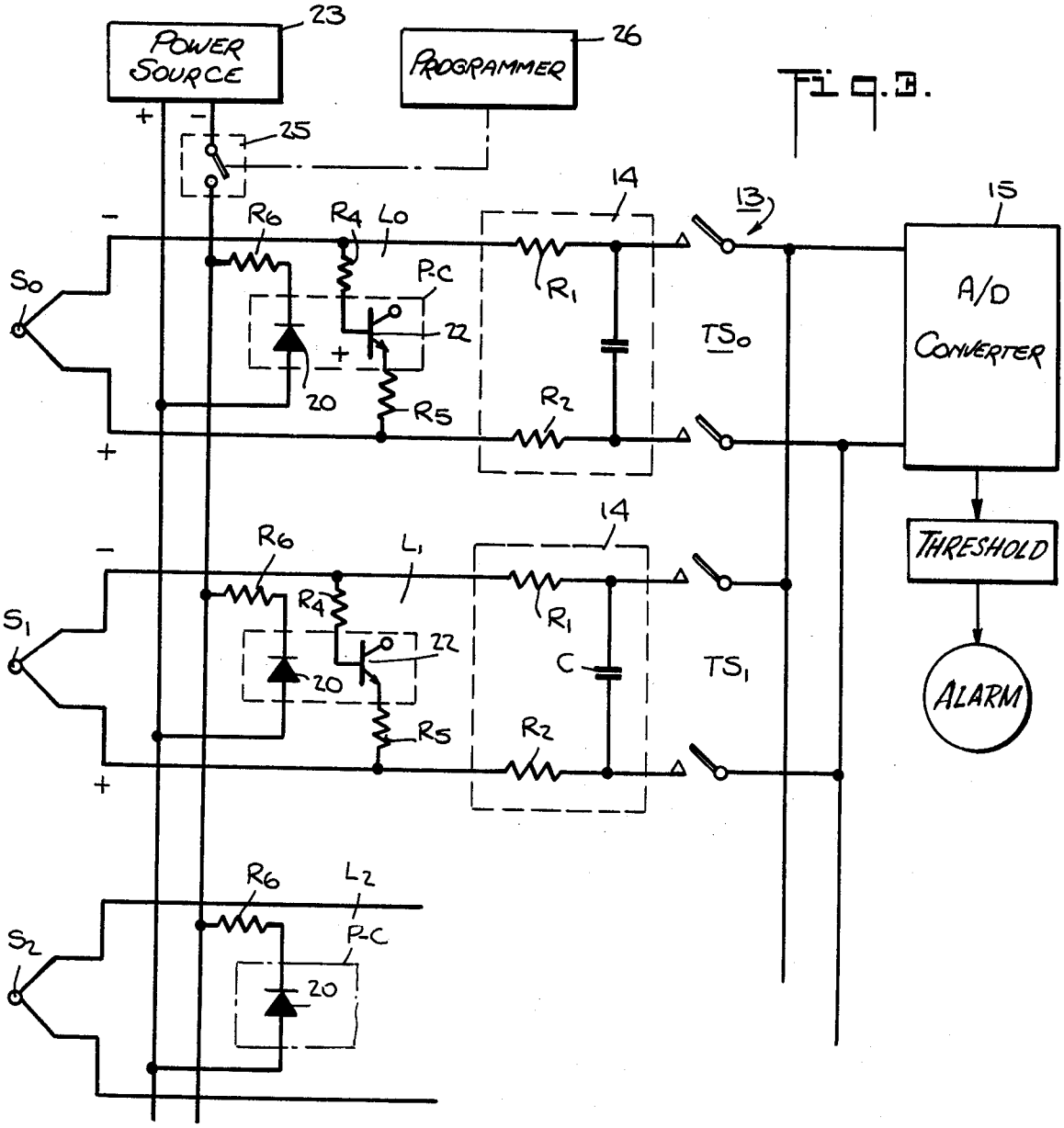
Figure 3:
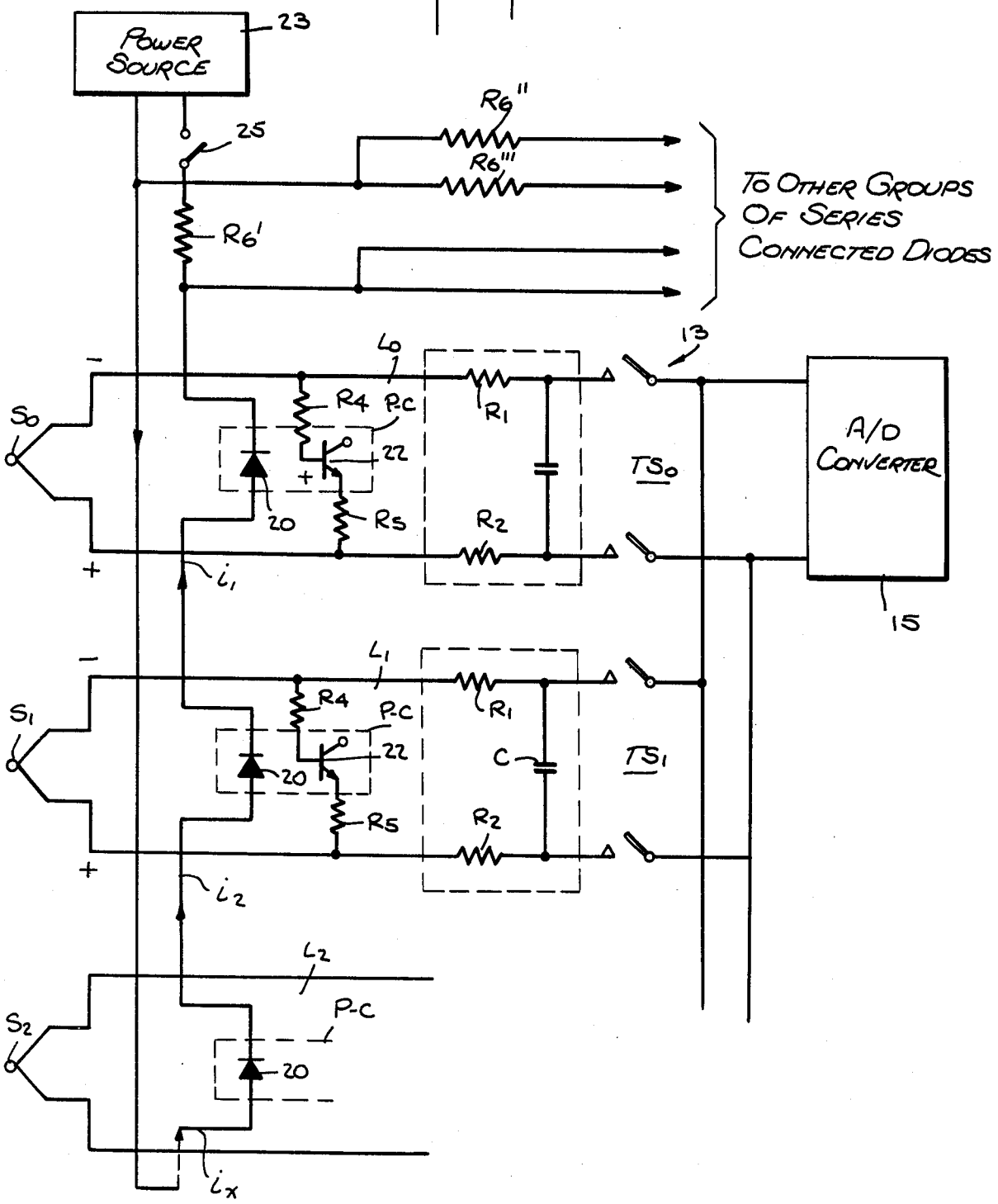

For a better understanding of the invention as well as other objects and further features thereof, reference is made to the following detailed description to be read in conjunction with the accompanying drawings, wherein:

FIG. 1 is a schematic diagram of a conventional digital multiplexing system operating in conjunction with a plurality of analog sensors;

FIG. 2 schematically illustrates a known form of individually-powered protective arrangement for the multiplexing system to detect and indicate the occurrence of an open circuit in any of the sensors;

FIG. 3 schematically illustrates a protective arrangement in accordance with the invention;

FIG. 4A shows in schematic form a suitable photon-coupler for use in the protective arrangement illustrated in FIG. 3, FIG. 4B being a perspective view of a commercial form of this photon-coupler; and FIG. 5 schematically shows an alternative arrangement for energizing the diodes of the photon-coupler.

DESCRIPTION OF INVENTION

The Multiplexing System

Referring now to FIG. 1, there is shown a conventional multiplex telemetry system including a transmitter 10 for conveying data from a group of analog sensors $S_0$ to $S_7$ over a single channel 11 to a central receiving terminal including a digital computer 12. While only eight sensors are shown, in practice a greater or smaller number may be employed.

In process control system, certain process varibles are converted into equivalent electrical signals which serve to adjust a final control element governing the process variable. Thus fluctuations in temperature may be sensed by a thermocouple which generates an analog voltage as a function of the temperature prevailing in a process line or tank. By way of example, devices $S_0$ to $S_7$ represent a plurality of low-impedance thermocouples functioning as analog sensors.

It is to be understood, however, that the invention is applicable to other forms of analog sensors such as sensors that make use of low-impedance reactive elements to convert changes in pressure, liquid level or some other process variable into a corresponding electrical analog value.

At transmitter 10, the plurality of (eight) analog signals generated by thermocouple sensors $S_0$ to $S_7$ are sequentially sampled by means of a transmitting commutator, generally designated by reference numeral 13, constituted by a like plurality (eight) of individually-actuatable switches $TS_0$ to $TS_7$. Sensor $S_0$ is coupled by a two-wire line $L_0$ to switch $TS_0$ through an R-C noise filter 14, and the other sensors are similarly connected by lines $L_1$, $L_2$ etc. to their correspondingly-numbered switches through respective noise filters 14.

All of the transmitting commutator switches are connected in parallel relation; and since the switches are actuated in sequence, data samples derived from analog sensors $S_0$ to $S_7$ are successively applied to the input of an analog-to-digital converter (ADC) 15. The output of converter 15 is amplified in amplifier 16 to a suitable level for transmission over channel 11 to digital computer 12 at the central receiving station. Since the output of converter 15 is a digital signal, amplification simply means a buffer or line driver circuitry which can switch large currents into a low impedance line.

In many cases, the ADC is already located in the control computer cabinets; hence the converter output is directly applied to the CPU through a group of input lines. If the ADC is in a remote data-gathering terminal, then its output might be transmitted to a central receiving station.

Computer 12 compares each of the digital samples derived from the sensors with a set point and yields a succession of digital control signals which are converted back to analog form by a digital-to-analog converter 17. The output of converter 17 is applied to a receiving commutator 18 operating in synchronism with the transmitting commutator 13. The eight switches of the receiving commutator are sequentially-actuated to provide output signals $O_0$ to $O_7$ for governing the final control elements associated with the respective processes being sensed by sensors $S_0$ to $S_7$.

In practice, each of lines $O_0$ to $O_7$ includes a sample-and-hold circuit, such as the analog hold circuit disclosed in Azegami U.S. Pat. No. 3,784,919. Each sample-and-hold circuit acts to convert the analog sample into a corresponding voltage whose amplitude is maintained for a period sufficient to avoid a gap between successively received samples, thereby producing a continuous rather than an intermittent output.

The transmitting and receiving commutator switches may be in electronic or electro-mechanical form. In the case of electromagnetically-actuated switches, the control voltages therefor are applied to the switch solenoids, whereas in the case of solid state switches, the control voltages are applied to the gate electrodes thereof. The manner in which the commutators are maintained in synchronous operation may be that disclosed in the Kazahaya U.S. Pat. No. 3,943,488.

Prior Art Protective Arrangement

Referring now to FIG. 2, there is shown an individually-powered protective arrangement for the analog sub-system of the conventional multiplexing system shown in FIG. 1. FIG. 2 shows the protective arrangement as applied to sensor circuits $S_0$ and $S_1$, the same arrangement being included in all other sensor circuits.

Sensor $S_0$ is connected by two-wire input line $L_o$ to A/D converter 15 through noise filter 14 which is composed of a capacitor C connected across the line and resistors $R_1$ and $R_2$ in series with the line wires.

The protective arrangement for each sensor is constituted by a high ohmic value resistor $R_3$ connected in series with a battery B across the line to develop an offset voltage resulting in an offset current I. The polarity of the battery is opposed to the polarity of the voltage developed by the sensor.

Thus an offset current is applied to each sensor input line from an individual power source. If sensor $S_0$, or whatever other sensor is being considered, is operating normally and is not open, the low-impedance sensor is shunted across the high-impedance network formed by the battery in series with the resistor and the offset current produced thereby is not effective.

In the normal state, the input sensor voltage developed across capacitor C of the filter will be converted to a digital value lying within the normal or valid range. But if sensor $S_0$ or any other sensor develops an open circuit, then the low-impedance shunt across the protective arrangement is lifted and filter capacitor C will then be charged by the offset current to a large negative value within the time constant of the filter. The A/D converter will then produce a corresponding digital value well outside the normal range. This abnormal value is indicated or recorded to call attention to the existence of a defective sensor and to alert an operator to correct this defect before it results in damage to the process or to the equipment.

Because the protective arrangement for each sensor in the system requires a separate battery, this gives rise to installation and maintenance problems; for unless all of the many batteries are in good condition, the protective arrangement cannot be relied on to call attention to an open-circuited sensor.

And if, in order to overcome this drawback, one seeks to derive individual voltages for the respective protective arrangements from a common source, these voltages must be isolated from each other to avoid interaction between the respective sensor input lines to which the voltages are applied. To effect such electrical isolation, costly expedients are required.

The Present Protective Arrangement

A protective arrangement in accordance with the invention makes use of standard opto-isolators or photon-couplers I-C of the type shown schematically in FIG. 4A. A photon-coupler is constituted by an injection-luminescent diode 20 which when energized by a power source, emits light whose rays are directed toward a photo-transistor 22. This photo-transistor generates an output voltage of $\approx$ 3 to 5 volts in accordance with the light intensity of light incident thereto.

In a commercial version of this photon coupler as shown in FIG. 4B, the photon-coupler I-C is housed within a plastic package to isolate it from ambient light, the external terminals providing the necessary connections to the diode and to the transistor.

Photo-transistor 22 is a junction transistor that may have only collector and emitter leads, or also a base lead. The base is exposed to light through a tiny lens. Collector current increases with light intensity as a result of amplification of base current by the transistor structure. Because the photon-coupler provides only optical coupling between the diode and photo-transistor, the photo-transistor is electrically isolated from the source supplying power to the diode.

Referring now to FIG. 3, which shows the present arrangement, it will be seen that each of the sensor input lines $L_0$, $L_1$, $L_2$ etc. has a photon-coupler I-C associated therewith. The base of photo-transistor 22 is connected through a resistor $R_4$ to one wire of the line and the emitter through a resistor $R_5$ to the other wire of the line to create an offset current network shunted across the two-wire line.

The light-emitting diodes 20 of the photon-couplers associated with all of the data input lines are connected in parallel to a common power source 23, eadh diode being provided with a current-limiting resistor $R_6$ in series therewith.

When the diode of a photon-coupler associated with a given sensor is energized to emit light which is intercepted by the photo-transistor 22, a photon EMF is generated across the base-emitter junction. This small voltage ($V_{ph} \approx \cdot 4v$) is applied to the two-wire line through resistors $R_4$ and $R_5$ of the network which have large ohmic values to generate a small offset current.

If the sensor is operating normally and is not open, it acts as a low-impedance shunt across the high-impedance photo-transistor network to render the offset current ineffective. But if any one of the sensors is open-circuited, then the low-impedance shunt across the offset network is lifted and the offset current resulting from the voltage $V_{ph}$ acts to charge filter capacitor C to a relatively high potential whose polarity is opposed to the polarity normally established thereacross by an operative sensor.

This potential is converted by A/D converter 15 to a digital value that is well out of the valid operating range. Means are provided, such as a threshold circuit, that is responsive to an abnormal digital value to set off an alarm or to otherwise alert an operator to the existence of a defective sensor.

Thus with the present arrangement, power source 23 is common to all sensor input lines, thereby doing away with the need for individual batteries for each line as in prior practice. And since the diode supply circuits are electrically-isolated from the data input lines, no expedients are required to effect such isolation.

The diodes may be continuously energized, in which case the collective current drain from the common source can be fairly substantial when many diodes are involved, even though each diode draws only a slight amount of current. This collective drain can be minimized by operating the diodes with an excitation current at about 20 percent of its specification value, for there is no need for a high-intensity light to generate the necessary offset current.

Alternatively, a switch 25 may be interposed in the power line leading to the diodes, the switch being under the control of a programmer 26 so arranged that power is supplied to the diodes only during a check-cycle, thereby minimizing the power requirements and prolonging the life of the power supply.

Photon-couplers of the type called for in the present arrangement are commercially available at very low cost (under a dollar per) and require no maintenance. Photo-couplers P-C and resistors $R_4$, $R_5$ and $R_6$ associated therewith may be potted in a small container provided with leads, thereby making installation of the protective arrangement in a data input line a very simple operation.

Alternative Diode Energization Arrangement

In the arrangement shown in FIG. 3, diodes 20 are connected in parallel relation to a common power source 23, each diode having its own limiting resistor $R_6$. An alternative arrangement is shown in FIG. 5 where a group of eight diodes is connected through a limiting resistor $R_6'$ in series relation to a common power source 23 which, for this purpose, is a +15 volt supply.

The diodes in this energization arrangement are divided into like groups of eight series-connected diodes, each group having its own limiting resistor $R_6''$, $R_6'''$, etc. Thus with a 100 ohm limiting resistor and a +15 volt supply, the current drawn by the series-connected diodes in a group of eight is $\simeq$5 mA, as distinguished from the much larger current drawn by a parallel-connected diode arrangement. Clearly, the series-connected diode arrangement requires fewer limiting resistors than the parallel-connected.

In all other respects, the system shown in FIG. 5 is the same in structure and function as that shown in FIG. 3.

While there has been shown and described a preferred embodiment of a protective arrangement for analog sensor multiplexing system in accordance with the invention, it will be appreciated that many changes and modifications may be made therein without, however, departing from the essential spirit thereof.

I claim:

1. In a multiplexing system in which a plurality of low-impedance analog sensors are connected by two-wire input data lines through noise filters to the respective switches of a commutator whose output is coupled to an analog-to-digital converter, said filters each including a capacitor, whereby analog data from the sensors is sequentially applied to said converter by the commutator to produce corresponding digital data within a predetermined normal range, a protective arrangement operating in conjunction with the system to detect the occurrence of an open circuit in any one of the sensors and to produce an indication of this abnormal condition, said arrangement comprising:

(A) a like plurality of photon-couplers associated with the respective data input lines, each coupler including a light-emitting diode to produce light which is inercepted by a photo-transistor;

(B) a common power source coupled to the diodes of the photon-couplers to energize the diodes and thereby cause the photo-transistors to generate a photo voltage;

(C) a high-impedance network connected across each data line and including the photo-transistor associated with the line to produce an offset current which is ineffective when the network is shunted by the low-impedance sensor under normal conditions, the sensor shunt being lifted when the sensor is open-circuited to cause the offset current to charge the filter capacitor to a potential level at which the corresponding digital value is outside said normal range to indicate an abnormal condition.

2. In a system as set forth in claim 1, wherein said sensors are thermocouples.

3. In a system as set forth in claim 1, wherein said sensors are reactive elements.

4. In a system as set forth in claim 1, wherein said photo-transistor including an emitter and a base and said network is provided with a resistor connecting said emitter to one wire of the line and a resistor connecting said base to the other wire thereof.

5. A system as set forth in claim 4, wherein said resistors have high-ohmic values.

6. A system as set forth in claim 1, further including programming means to interrupt the supply from said source to said diodes except during check cycles.

7. A system as set forth in claim 1, wherein said diodes are connected in parallel to said power source.

8. A system as set forth in claim 7, further including a current-limiting resistor in series with each diode.

9. A system as set forth in claim 1, wherein said diodes are connected in series with said source through a current-limiting resistor.

* * * * *

UNITED STATES PATENT OFFICE

CERTIFICATE OF CORRECTION

Patent No. 4,155,080 Dated May 15, 1979

Inventor(s) LASZLO KOVACS

It is certified that error appears in the above-identified patent and that said Letters Patent are hereby corrected as shown below:

Column 4, line 13 "system" should have read -- systems --
Column 4, line 13, "varibles" should have read -- variables --
Column 6, line 37, "eadh" should have read -- each --
Column 7, line 38, "100" should have read -- 1,000 --
Column 8, line 17 "inercepted" should have read -- intercepted --

Signed and Sealed this

Thirteenth Day of January 1981

[SEAL]

Attest:

SIDNEY A. DIAMOND

Attesting Officer

Commissioner of Patents and Trademarks